US005597046A

United States Patent [19]

Fisk

[11] Patent Number: 5,597,046

[45] Date of Patent: Jan. 28, 1997

[54] GUIDED MOLE

[75] Inventor: Allan T. Fisk, Needham, Mass.

[73] Assignee: Foster-Miller, Inc., Waltham, Mass.

[21] Appl. No.: 420,663

[22] Filed: Apr. 12, 1995

[51] Int. Cl.[6] ..... E21B 7/04

[52] U.S. Cl. ..... 175/67; 175/19; 175/45; 405/154; 405/184

[58] Field of Search ..... 405/184, 154; 175/21, 67, 73–76, 61, 62, 45, 231, 19

[56] References Cited

U.S. PATENT DOCUMENTS

| | | | |
|---|---|---|---|
| 2,075,064 | 3/1937 | Schumacher et al. . | |
| 2,153,680 | 4/1939 | Schumacher et al. . | |
| 2,196,940 | 4/1940 | Potts . | |
| 2,324,102 | 7/1943 | Miller et al. . | |
| 2,350,986 | 6/1944 | Collins . | |
| 2,686,660 | 8/1954 | Storm . | |
| 2,873,092 | 2/1959 | Dwyer . | |
| 2,903,239 | 8/1959 | Standridge . | |
| 3,211,244 | 10/1965 | Cordary . | |
| 3,419,091 | 12/1968 | Garnder . | |
| 3,467,211 | 9/1969 | Goodwin et al. . | |
| 3,525,405 | 8/1970 | Coyne et al. . | |
| 3,712,391 | 1/1973 | Coyne . | |
| 3,878,903 | 4/1975 | Cherrington . | |
| 4,396,073 | 8/1983 | Reichman et al. . | |
| 4,440,242 | 4/1984 | Schmidt et al. | 175/67 X |
| 4,519,462 | 5/1985 | Kelley | 175/67 X |
| 4,632,191 | 12/1986 | McDonald et al. | 175/61 |
| 4,679,637 | 7/1987 | Cherrington et al. . | |
| 4,694,913 | 9/1987 | McDonald et al. | 175/61 |
| 4,714,118 | 12/1987 | Baker et al. . | |
| 4,787,463 | 11/1988 | Geller et al. . | |
| 4,834,193 | 5/1989 | Leitko et al. . | |
| 4,858,704 | 8/1989 | McDonald et al. . | |
| 4,867,255 | 9/1989 | Baker et al. . | |
| 4,907,658 | 3/1990 | Stangl et al. . | |
| 4,919,204 | 4/1990 | Baker et al. | 175/67 X |
| 4,921,055 | 5/1990 | Kayes . | |
| 4,953,638 | 9/1990 | Dunn . | |
| 4,993,503 | 2/1991 | Fischer et al. . | |
| 5,002,137 | 3/1991 | Kickinson et al. . | |
| 5,010,965 | 4/1991 | Schmelzer | 175/45 X |
| 5,078,218 | 1/1992 | Smet | 175/45 |
| 5,163,520 | 11/1992 | Gibson et al. . | |
| 5,255,749 | 10/1993 | Bumpurs et al. . | |
| 5,322,391 | 6/1994 | Fisk | 175/73 |
| 5,350,254 | 9/1994 | Fisk et al. | 405/184 |

FOREIGN PATENT DOCUMENTS

| | | | |
|---|---|---|---|
| 494477 | 7/1953 | Canada | 175/21 |
| 2126267 | 3/1984 | United Kingdom . | |

*Primary Examiner*—Dennis L. Taylor
*Attorney, Agent, or Firm*—Fish & Richardson P.C.

[57] ABSTRACT

Moling apparatus for forming a generally horizontal underground passage in soil for a utility conduit or the like includes tool head structure with a base portion and a nose portion mounted on the base portion such that an interface region is formed between nose portion and base portion surfaces. The base portion is movable along that interface relative to the nose portion between a first position in which nose portion surfaces are symmetrical with respect to the tool axis so that the tool will tend to move along a straight line path and a second position in which nose portion surfaces are in asymmetrical position with respect to the tool axis so that the tool will tend to move along a curved path. The apparatus includes structure for creating positive pressure during system operation in the interface region between the base portion and nose portion such that relative movement of the nose and base portions between the first and second positions is not significantly impaired.

18 Claims, 3 Drawing Sheets

GUIDED MOLE

BACKGROUND OF THE INVENTION

This invention relates to apparatus for boring underground horizontal passageways.

Horizontally bored underground passageways for pipelines and utilities such as electrical distribution lines provide a safe, economical and environmentally responsible alternative to digging through or building over natural terrain and manmade obstacles.

A wide variety of underground passageway boring methods and apparatus for installation of utility cables, pipes and the like are known. Those known techniques include the use of a pneumatic impact piercing tool (sometimes termed a "mole") to punch a hole through soil without the need to excavate an open trench in which to lay the pipe or cable. Unguided moles are easily deflected off course by common anomalies, such as rocks, found in the soil. Improved moling apparatus for forming generally horizontal underground passages in the soil for a utility conduit or like are shown in U.S. Pat. Nos. 5,322,391 and 5,350,254. Such apparatus includes tool head structure with a base portion and a nose portion that is rotatably mounted on the base portion. Rotation of the base portion relative to the nose portion shifts the nose portion between a first position in which nose portion surfaces are symmetrical with respect to the tool axis so that the tool will move along a generally straight path and a second position in which nose portion surfaces are in asymmetric position with respect to the tool axis so that the tool will move along a generally curved path. That guided mole is preferably maintained in the straight line moling mode (symmetrical) tool configuration and shifted from the straight line configuration to a steered (asymmetrical) configuration by rotating the body portion relative to the nose portion (which tends not to rotate relative to the soil). The interface between the base portion and nose portion is exposed to soil materials, and it is desirable that that interface be maintained (for instance, clean and lubricated) such that the relative movement between the base portion and nose portion is without significant impairment.

SUMMARY OF THE INVENTION

In accordance with one aspect of the invention, there is provided moling apparatus for forming a generally horizontal underground passage in soil for a utility conduit or the like which includes tool head structure with a base portion and a nose portion mounted on the base portion such that an interface region is formed between nose portion and base portion surfaces. The base portion is movable along that interface relative to the nose portion between a first position in which nose portion surfaces are symmetrical with respect to the tool axis so that the tool will tend to move along a straight line path and a second position in which nose portion surfaces are in asymmetrical position with respect to the tool axis so that the tool will tend to move along a curved path. The apparatus includes structure for creating positive pressure during system operation in the interface region between the base portion and nose portion such that relative movement of the nose and base portions between the first and second positions is not significantly impaired.

Preferably, the apparatus includes an impactor mechanism which generates impacts for propelling the tool through the soil. A channel extends from the impactor mechanism to the interface region and operation of the impactor mechanism creates a positive pressure in the interface region for excluding debris from, cleaning and/or lubricating that interface region.

In particular embodiments, the impactor structure includes piston structure and anvil structure, and the channel structure includes check valve structure; the interface region defines a swash plane disposed at an angle in the range of 2–20 degrees to the tool axis; structure is provided for introducing lubricating material into the interface region; and the interface region includes seal structure. In a particular embodiment, the apparatus includes torsional force applying structure comprising elongated torsionally stiff structure in the form of an air hose connected to the tool and adapted to extend to the surface of the soil in which the passage is to be formed; operator controllable torque generating structure applies torsional force to the air hose at the surface of the soil in which the passage is to be formed; and transmitter structure is included in the moling apparatus for supplying positional information to a point above the surface of the soil; and the nose portion is mounted on the base portion for rotation about a swash axis that is at an angle to the tool axis. In another embodiment, the nose portion is mounted on the base portion for rotation about an axis that is parallel to and offset from the tool axis.

Other features and advantages of the invention will be seen as the following description of particular embodiments progresses, in conjunction with the drawings, in which.

DESCRIPTION OF PARTICULAR EMBODIMENTS

Figure 1:
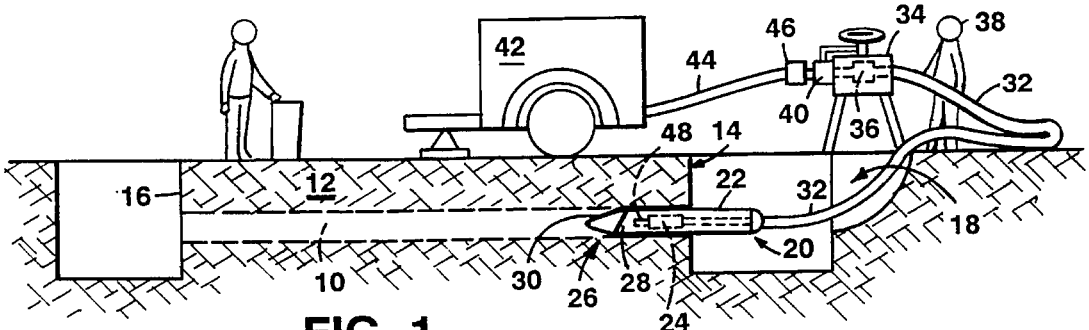
FIG. 1 is a diagrammatic view of horizontal boring apparatus according to the invention.

The schematic diagram of FIG. 1 shows a system for boring underground passageway 10 through strata 12 that may be relatively unconsolidated soil such as sand, clay or gravel for an electric cable interconnection between launch pit 14 and target pit 16. The system includes mole 20 with body portion 22 that includes percussive impactor mechanism 24 and head portion 26 that includes base portion 28 and nose portion 30. Coupled to mole 20 is torsionally stiff air hose 32 which follows mole 20 into bore passage 10. Torque controller 34 may be located near launch pit 14 and may include a bidirection (clockwise/counterclockwise) vane type air motor 36 with its output shaft rigidly affixed to air supply hose 32. The air motor input shaft may be hollow allowing supply air to be fed from inlet 40 of controller 34 through air motor 36 into hose 32. Suitable valving allows operator 38 to adjust air pressure to motor 36 and to turn on and off the impactor mechanism 24 in mole 20. Air compressor 42 supplies air over air supply hose 44 and hose swivel 46. Mole 20 also houses transmitter 48. Further details of the moling system which may be had with reference to U.S. Pat. Nos. 5,322,391 and 5,350,254, the disclosures of which are specifically incorporated herein by reference.

Figure 2:
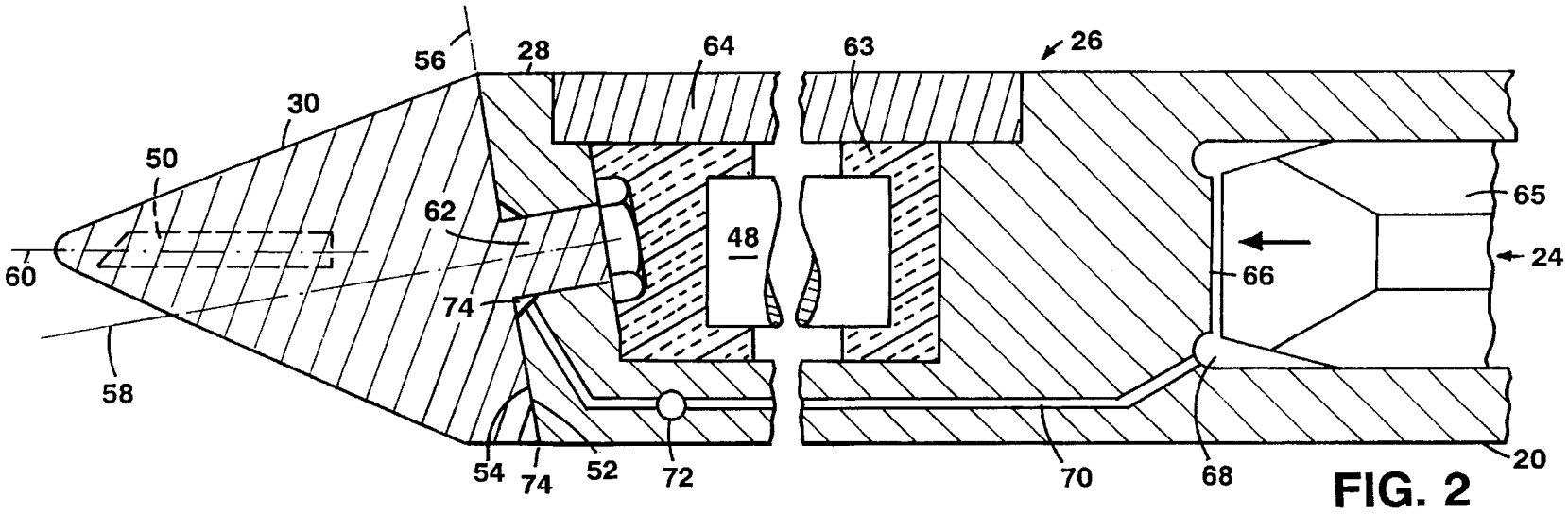
FIG. 2 is a side view of the boring head of the apparatus shown in FIG. 1 in a first position.
Figure 3:
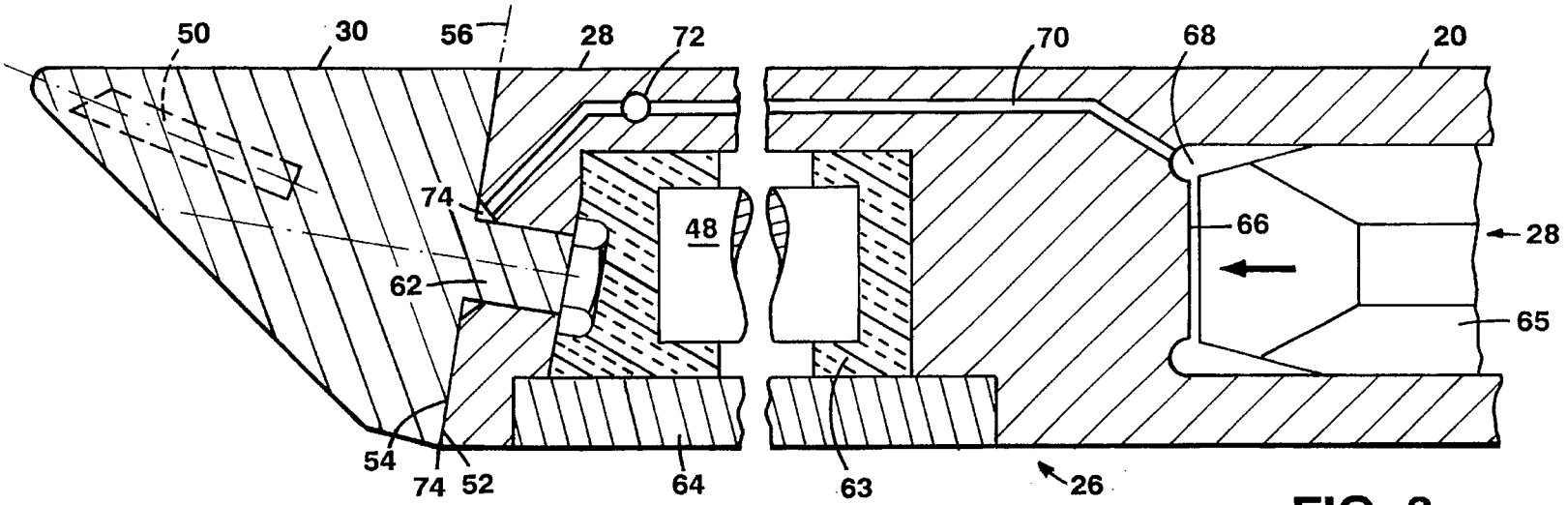
FIG. 3 is a side view of the boring head of FIG. 2 in a second position.

With reference to FIGS. 2 and 3, mole 20 includes nose portion 30 with ribs 50. The interface region 74 between surface 52 of nose portion 30 and surface 54 of base portion 28 forms a swash plane 56 that defines a swash axis 58, as defined by shaft 62 disposed at an angle of 10° to axis 60 of base portion 28. Nose piece 30 is of generally conical configuration and ribs 50 are offset 10° from swash axis 58. Base portion 28 is rotatable 180° about axis 60 between a first (symmetrical head configuration) position (FIG. 2) and a second (asymmetrical head configuration) position (FIG. 3) relative to tool axis 60.

Battery powered tracking transmitter 48 is mounted in shock isolation material 63 in the forward end of body portion 20 in a chamber that is accessible through cover 64. Rearwardly of transmitter 48 in body portion 20 is percussive impactor mechanism 24 that includes reciprocating piston 65 that strikes anvil portion 66. The annular chamber 68 contains air at a pressure above ambient during the cycling of piston 65. When the mole 20 is not running, there is ambient pressure in chamber 68.

Passage 70 extends from impactor chamber 68 through optional check valve 72 to interface region 74 at shaft 62. During operation of mole 20, a pulsating air stream is applied through passage 70 to interface region 74 and provides flushing of the interface zone and inhibits dirt and contamination from entering the swash plane/bearing area, thereby enhancing the freedom of nose portion 30 to rotate relative to base portion 28 and to reduce jamming. The optional check valve 72 prevents water from flowing through passage 70 into chamber 68 when the mole 20 is submerged but not running. When the mole is operating, the flow of air through passageway 70 prevents water intrusion.

Figure 4:
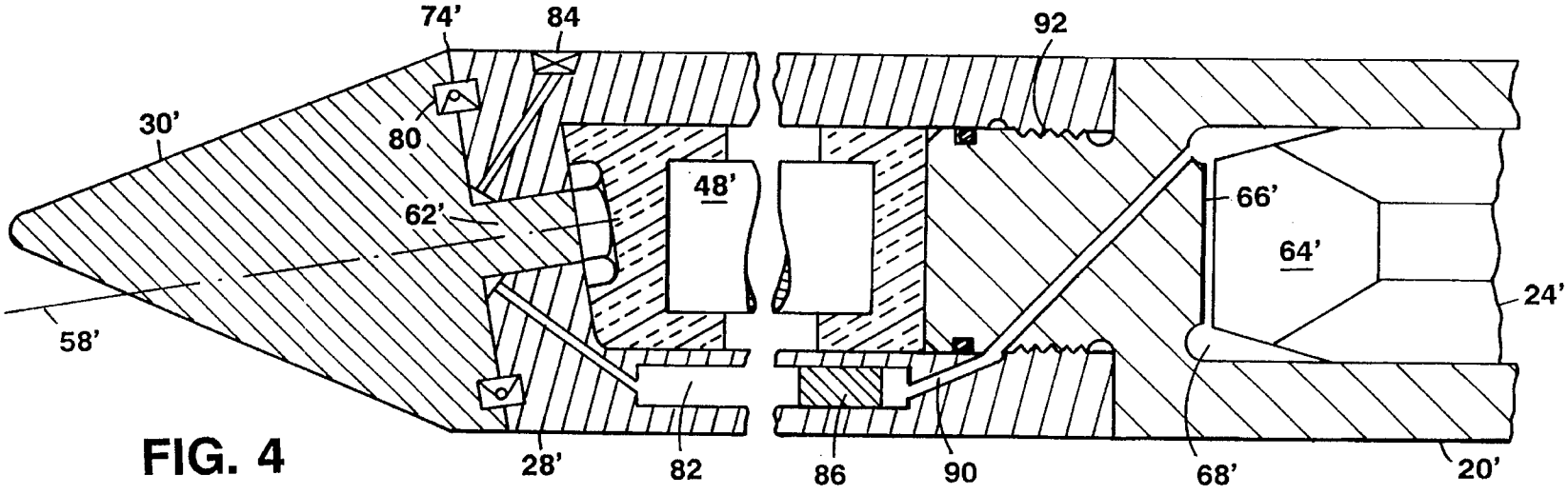
FIG. 4 is a side view of a second embodiment of apparatus according to the invention.
Figure 5:
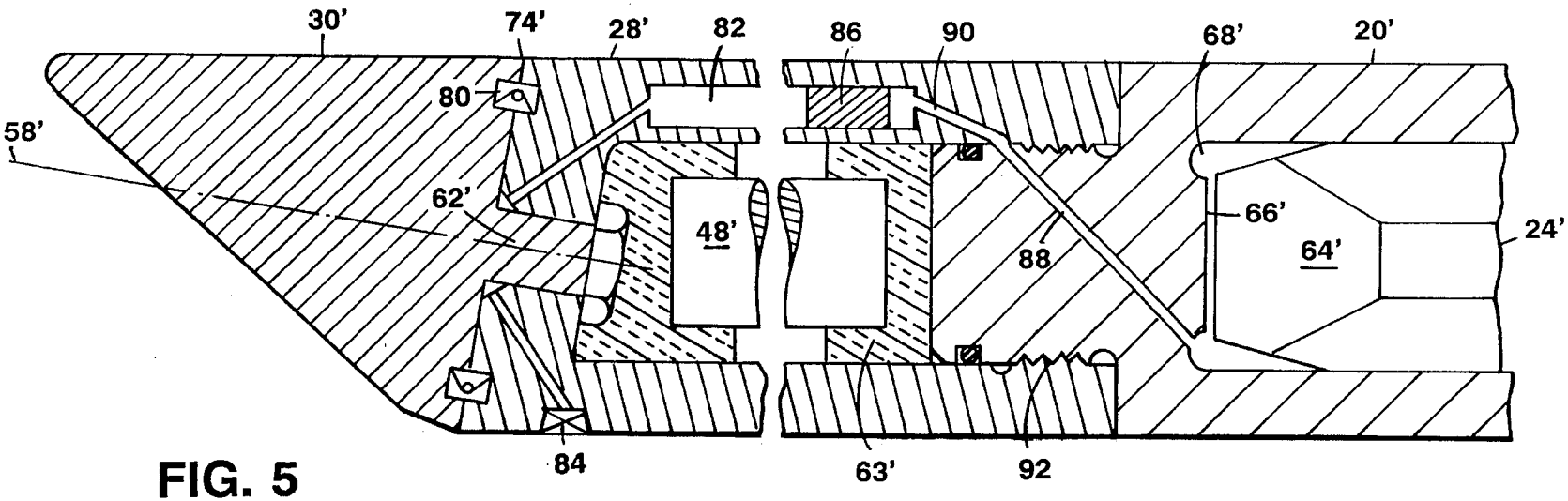
FIG. 5 is a side view of the boring head of FIG. 4 in a second position.

A second embodiment is shown in FIGS. 4 and 5, FIG. 4 showing the mole in symmetrical condition and FIG. 5 showing the mole in asymmetrical position. Similar elements are identified by corresponding primed reference numerals. The embodiment shown in FIGS. 4 and 5 includes seal 80 in interface region 74'; grease reservoir 82; grease fitting 84 for injecting lubricant into reservoir 82; and reciprocating free piston 86 in reservoir 82. Passages 88, 90 provide communication between impactor chamber 68' and grease reservoir 82. As grease is consumed, piston 86 strokes forward under air pressure supplied over passages 88, 90 to force supplemental grease into the bearing/seal area in the interface region 74' between nose 30' and body portion 28'. The forward end of body portion 20' is attached to base portion 28' by threaded section 92.

While particular embodiments of the invention have been shown and described, various modifications will be apparent to those skilled in the art, and therefore, it is not intended that the invention be limited to the disclosed embodiment, or to details thereof, and departures may be made therefrom within the spirit and scope of the invention.

What is claimed is:

1. Moling apparatus for forming a generally horizontally underground passage in soil for a utility conduit or the like comprising tool head structure having a tool axis and a base portion, a nose portion mounted on said base portion such that an interface region is formed between surfaces of said nose and base portions, said nose portion being movable relative to said base portion between a first position in which surfaces of said nose portion are symmetrical with respect to the tool axis so that the tool will move through soil along a generally straight path, and a second position in which said nose surfaces are in asymmetrical position with respect to said tool axis so that said tool will tend to move through soil along a curved path in response to propulsion forces applied to said tool head structure, structure for creating a positive pressure during system operation, a reservoir containing a displaceable lubricating material communicating with said structure for creating a positive pressure, and a channel from said reservoir to said interface region between said base portion and said nose portion.

2. The apparatus of claim 1 wherein said positive pressure creating structure includes impactor structure mechanism for generating a series of impacts for propelling said apparatus through soil, and channel structure extending from said impactor structure to said interface region for applying pressure pulses from said impactor structure to create a positive pressure in said interface region during operation of said moling apparatus.

3. The apparatus of claim 2 wherein said impactor structure includes piston structure and anvil structure.

4. The apparatus of claim 2 wherein said channel structure includes check valve structure.

5. The apparatus of claim 2 and further including piston structure in said channel structure.

6. The apparatus of claim 1 wherein said interface region defines a swash plane disposed at an angle in the range of 2–20 degrees to said tool axis.

7. The apparatus of claim 1 and further including seal structure in said interface region between said base portion and said nose portion.

8. The apparatus of claim 1 and further including torsional force applying structure comprising elongated torsionally stiff structure connected to said tool head structure and adapted to extend to the surface of the soil in which said passage is to be formed.

9. The apparatus of claim 8 and further including pneumatically actuated impactor structure, and said torsionally stiff structure is an air hose for supplying pressurized air to said impactor structure.

10. The apparatus of claim 9 wherein said impactor structure includes piston structure and anvil structure.

11. The apparatus of claim 10 and further including seal structure in said interface region between said base portion and said nose portion.

12. The apparatus of claim 9 and further including operator controllable torque generating structure for applying torsional force to said air hose at the surface of the soil in which said passage is to be formed.

13. The apparatus of claim 1 and further including transmitter structure in said moling apparatus for supplying positional information to a point above the surface of the soil in which said passage is to be formed.

14. The apparatus of claim 13 wherein said nose portion is mounted on said base portion for rotation about a swash axis that is at an angle to said tool axis.

15. The apparatus of claim 14 and further including torsional force applying structure comprising a torsionally stiff air hose connected to said tool head structure and adapted to extend to the surface of the soil in which said passage is to be formed, pneumatically actuated impactor structure, channel structure extending from said impactor structure to said interface region for applying pressure pulses from said impactor structure to create a positive pressure in said interface region during operation of said moling apparatus, said air hose supplying pressurized air to said impactor structure, and operator controllable torque generating structure for applying torsional force to said air hose at the surface of the soil in which said passage is to be formed.

16. The apparatus of claim 14 wherein said nose portion is mounted on said base portion for rotation about an axis that is parallel to and offset from said tool axis.

17. The apparatus of claim 14 and further including structure for introducing lubricating material into said interface region and seal structure in said interface region.

18. The apparatus of claim 17 and further including piston structure in said channel structure.

* * * * *